US008444790B2

(12) United States Patent
Tong

(10) Patent No.: US 8,444,790 B2
(45) Date of Patent: May 21, 2013

(54) MULTI-LAYER INTUMESCENT FIRE PROTECTION BARRIER WITH ADHESIVE SURFACE

(75) Inventor: Jiangdong Tong, London (CA)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/315,980

(22) Filed: Dec. 9, 2011

(65) Prior Publication Data

US 2012/0080144 A1 Apr. 5, 2012

Related U.S. Application Data

(63) Continuation of application No. 12/366,162, filed on Feb. 5, 2009, now abandoned.

(60) Provisional application No. 61/027,148, filed on Feb. 8, 2008.

(51) Int. Cl.

| | |
|---|---|
| ***E04F 13/073*** | (2006.01) |
| ***E04F 13/074*** | (2006.01) |
| ***E04F 13/075*** | (2006.01) |
| ***B29C 65/48*** | (2006.01) |
| ***B32B 37/12*** | (2006.01) |
| ***B32B 37/14*** | (2006.01) |
| ***B32B 38/10*** | (2006.01) |
| ***B05D 5/10*** | (2006.01) |

(52) U.S. Cl.

USPC ..... 156/71; 156/249; 156/289; 427/208.4; 427/208.8

(58) Field of Classification Search

USPC ..... 156/71, 247, 249, 289; 427/207.1, 427/208.4, 208.8, 421.1, 427.4

See application file for complete search history.

(56) References Cited

U.S. PATENT DOCUMENTS

| | | | |
|---|---|---|---|
| 3,733,289 | A | 5/1973 | Burns |
| 3,934,066 | A | 1/1976 | Murch |
| 4,058,643 | A | 11/1977 | Marshall et al. |
| 4,223,066 | A | 9/1980 | Boyle |
| 4,486,468 | A | 12/1984 | Gray |
| 5,057,251 | A | 10/1991 | Skold |
| 5,516,552 | A | 5/1996 | Bontrager et al. |

(Continued)

FOREIGN PATENT DOCUMENTS

| | | | |
|---|---|---|---|
| KR | 2002-0034134 | | 5/2002 |
| WO | WO 94/17142 | | 8/1994 |
| WO | WO 0105886 | A1 * | 1/2001 |
| WO | WO 2005/000975 | A1 | 1/2005 |

OTHER PUBLICATIONS

International Search Report, PCT/US2009/031488, mailed May 26, 2009, 3 pages.

*Primary Examiner* — Sing P Chan

(74) *Attorney, Agent, or Firm* — Kenneth B. Wood

(57) ABSTRACT

An intumescent fire protection barrier in the form of an adhesive sheet or continuous roll of tape. The barrier comprises laminated layers of an intumescent material, a reinforcing matrix, a pressure sensitive adhesive and a release liner. The intumescent material is adhesively applied to a structural steel substrate and expands by at least 10 times its original thickness during a fire to provide fire protection to the substrate. Multiple layers of the fire protection barrier may be installed on top of one another. This application method dramatically reduces installation time as compared with sprayed on fire protection coatings.

20 Claims, 7 Drawing Sheets

U.S. PATENT DOCUMENTS

| | | | |
|---|---|---|---|
| 5,591,791 | A | 1/1997 | Deogon |
| 5,681,640 | A | 10/1997 | Kiser |
| 5,851,663 | A | 12/1998 | Parsons et al. |
| 6,274,647 | B1 | 8/2001 | Knight et al. |
| 6,340,645 | B1 | 1/2002 | Horacek et al. |
| 6,866,928 | B2 | 3/2005 | Narum et al. |
| 7,118,272 | B2 | 10/2006 | Bobenhausen |
| 2003/0175497 | A1 | 9/2003 | Kobe et al. |

* cited by examiner

MULTI-LAYER INTUMESCENT FIRE PROTECTION BARRIER WITH ADHESIVE SURFACE

CROSS-REFERENCE TO RELATED APPLICATIONS

This application is a continuation of U.S. patent application Ser. No. 12/366,162, filed Feb. 5, 2009, now abandoned, which claimed the benefit of U.S. Provisional Patent Application No. 61/027,148, filed Feb. 8, 2008, the disclosures of both of which are incorporated by reference herein in their entirety.

FIELD OF THE INVENTION

The present invention relates to intumescent fire protection barriers. More particularly, the present invention relates to multi-layer adhesive tapes, sheets or wraps comprising separate layers of an intumescent material and an adhesive material that are useful for fire protection in buildings or other structures.

BACKGROUND

The necessity of protecting structural steel such as columns, beams, girders and other steel assemblies from the damaging effect of fire is an important part of modern building design. Steel does not burn, but can lose strength at high temperatures. As a result, a variety of fire protection systems have been developed to insulate steel from the effects of fire in order to prolong the time required for steel to reach a temperature of about 538° C., generally by at least two hours, depending upon local fire regulations.

Intumescent coatings are coatings that react under the influence of heat and swell to 10-100 times their original thickness, producing an insulating char that protects the substrate to which the coating is applied from the effects of fire. Due to the fact that intumescent coatings are applied at a relatively low thickness, as compared with the thickness required for other types of insulating materials to achieve a similar fire protection rating, they are increasingly becoming the preferred choice for structural fire protection. Another attractive feature of intumescent coatings is their smooth and aesthetically pleasing finish. Thin film intumescent coatings therefore allow architects and designers to maximize the creative design possibilities of structural steel.

Typical intumescent coatings usually comprise a minimum of four components: a source of mineral acid catalyst, typically ammonium polyphosphate; a source of carbon, typically pentaerythritol or dipentaerythritol; a blowing agent, typically melamine; and a binder, typically a thermoplastic resin. When an intumescent coating is subjected to heat, a series of reactions occur. The ammonium polyphosphate decomposes to produce polyphosphoric acid, catalyzing the dehydration of pentaerythritol to produce char. The blowing agent also starts to decompose, giving off non-flammable gases that cause the carbon char to foam, thus producing a meringue-like structure that is highly effective in insulating the substrate from heat. The basic function of the binder is to bind together the components of the intumescent coating, so that they may be applied to the substrate and held in intimate contact therewith until required to perform their function in a fire situation. Furthermore, the binder contributes to the formation of a uniform cellular foam structure, since the molten binder helps trap the gases given of by the decomposing blowing agents, thus ensuring a controlled expansion of the char.

Intumescent coatings are generally categorized into three types: water based, solvent based, and epoxy based. Water-based and solvent-based intumescent coatings are among the most widely used products (over 80% usage in the North American market). These coatings utilize a thermoplastic binder, such as polyvinyl chloride (PVC), polyurethane, polyester, polyvinyl acetate, phenolic resin or acrylic resin. The thermoplastic characteristics of the binder allow the coating to swell significantly (with blowing agent) and form chars 10-100 times the original coating thickness. Therefore, only a relatively thin film is required with water or solvent based coatings. However, a significant drawback of these types of coatings is the time associated with installation. Depending on the coating thickness required for fireproofing, a project could last from 2 days to over one week, since only a limited thickness (usually 40-50 mils or 1.0-1.2 mm per day) can be sprayed in a single application without sagging or peeling. The coating must be allowed to dry before a second layer can be applied, prolonging the overall installation time. Environmental conditions, such as humidity, can affect the drying time of the coating. In addition, a trained applicator must apply the coating to ensure that a uniform thickness is applied. For solvent-based systems, the applicator must be aware of special safety considerations, for example inhalation hazards and flammability. Finally, sprayed on coatings are messy and necessitate extensive cleanup of the job site following installation. In order to solve some or all of these problems in the art, improved fire protection barriers are needed.

Epoxy-based coatings (e.g. PPG's Pitt-Char® and Akzo Nobel's Chartek® systems) have great durability and are mostly used for outdoor applications, such as offshore platforms or industrial plants. Because of the thermosetting nature of epoxy resins, epoxy-based coatings swell poorly upon heating (only a few times their original thickness) and consequently require greater amounts to be applied in order to attain the desired fire protection rating. The cost of epoxy systems is usually much higher than water-based and solvent-based systems, meaning that the overall project cost is prohibitive for interior applications. In addition, the aesthetic finish is compromised due to the much greater coating thickness required.

Coatings are often reinforced using, for example, short length pieces of fiberglass mixed with the coating during application. The random direction of the fibers mixed throughout the coating lends reinforcement, reducing the likelihood of sagging, and allowing greater overall coating thickness to be applied to increase fire protection ratings beyond what can be achieved without reinforcement. However, the use of fiberglass reinforcement is messy and does not mitigate the other disadvantages of sprayed on coatings.

Fiberglass insulating batons impregnated with a form of carbon called graphite (another intumescent material) are used as wraps in certain fire protection applications. These wraps do not generally comprise a continuous adhesive layer along the face being affixed to the substrate. The wraps can occasionally employ an adhesive strip in order to adhere a portion of the wrap to itself; however, the wrap then only remains in contact with the substrate due to friction. The lack of intimate contact between the wrap and the material being protected from fire means that, upon charring, the intumescent material has an increased likelihood of prematurely detaching from the substrate, which compromises fire protection.

When an intumescent material is applied around corners or to a rounded exterior surface (such as to a hollow tube or around a structural I-beam), fissures can develop upon expansion of the material during a fire. These fissures can propagate all of the way through to the substrate, thereby leading to premature exposure of the material in a fire situation. It would therefore be desirable to reduce the likelihood of fissure propagation through to the substrate material.

U.S. Pat. No. 5,851,663 (Parsons, et al.) discloses a pressure sensitive adhesive composition that includes an intumescent material intermingled therewith. The intumescent material is added to increase fire resistance of the tape itself, rather than to act as a fire protection barrier for the substrate it is adhered to. No multi-layer fire protection barrier is disclosed that comprises separate layers of intumescent material and adhesive. In addition, the maximum reported expansion of the composition is 7.5 times, which is generally considered insufficient for use in fire barrier applications.

U.S. Pat. No. 6,866,928 (Kobe, et al.) and US Patent Publication 2003/0175497 (Fischer, et al.) both describe fire retardant tapes comprising a stretchable release layer. These tapes do not comprise a layer of an intumescent material and exhibit little or no expansion during a fire. These tapes are therefore not suitable for use as intumescent fire protection barriers.

Korean Patent Publication 2002034134 (Cho, J. Y.) discloses a thermally expanding fire retardant tape comprising a thin steel plate with a plurality of slits therethrough that is coated with a synthetic rubber composition consisting of an olefinic polymer mixed with a fire retardant material. The fire retardant material is therefore not provided in a separate layer. The steel plate also impedes flexibility of the tape and increases its weight, making it difficult to apply as a fire protection barrier.

U.S. Pat. No. 5,681,640 (Kiser) discloses a fire protection barrier comprising folded layers of a metallic fire resistant material and an intumescent material. The layers are designed to unfold during a fire to permit expansion of the intumescent material. The fire protection barrier may be attached to a substrate using a strip of adhesive tape. No porous continuous reinforcing matrix is disclosed. Due to its folded nature, this barrier is not suitable for sequential application in multiple layers.

U.S. Pat. No. 4,058,643 (Marshall, et al.) describes a fire protection barrier comprising a fiberglass insulation material adhesively bonded to a plastic sheath. The adhesive comprises an intumescent material that expands during a fire to prevent the sheath from melting and wicking into the fiberglass insulation. There are no separate intumescent and adhesive layers and no adhesive attachment to the substrate.

A need therefore still exists for improved intumescent fire protection barriers comprising an adhesive layer for attachment of the barrier to a substrate.

SUMMARY OF THE INVENTION

According to an aspect of the present invention, there is provided a multi-layer fire protection barrier comprising: a first layer comprising an intumescent material; a second layer comprising a continuous reinforcing matrix; a third layer comprising a pressure sensitive adhesive; and, a fourth layer comprising a release liner removably adhered to the third layer.

According to another aspect of the present invention, there is provided a method of protecting a building component from fire damage comprising: providing a multi-layer fire protection barrier as previously described; removing the fourth layer from the fire protection barrier to expose the third layer; and, applying the pressure sensitive adhesive of the third layer to a surface of the building component to adhesively attach the fire protection barrier to the building component.

According to yet another aspect of the present invention, there is provided a method of making a multi-layer fire protection barrier comprising: providing a continuous strip of a release liner having a pressure sensitive adhesive applied thereto; providing a continuous length of a reinforcing matrix; spray coating an intumescent material along the reinforcing matrix; and, adhering the pressure sensitive adhesive to the reinforcing matrix.

The intumescent material may be intimately co-mingled with the reinforcing matrix. In one embodiment, the reinforcing matrix may form a surface to which the intumescent material is applied. In another embodiment, the reinforcing matrix may be porous and the intumescent material may be co-mingled with the reinforcing matrix. The intumescent material may permeate the reinforcing matrix and the reinforcing matrix may be located partially or entirely within the intumescent material. The reinforcing matrix may be woven or non-woven and may comprise a fibrous thermoplastic material, such as a screen, web, scrim or veil made from, for example, a polyester, polyamide, polyimide, polyurethane, polyvinylchloride or polyaramid material.

A greater intumescent thickness can be applied in a single layer of the fire protection barrier of the present invention than with conventional fire protection coatings. A thickness of from 0.25 to 3 mm of intumescent can be employed, preferably from 0.5 to 1 mm, in a single layer. This advantageously reduces application time and permits a greater quantity of intumescent material to be applied around corners than in conventional spray coatings. In addition, multiple layers of the fire protection barrier can be installed, without waiting for the previous layers to cure; this dramatically reduces installation time and cost for projects requiring an overall intumescent thickness greater than the thickness of a single layer of the fire protection barrier. Any desired intumescent coating thickness can be provided in this manner.

It has surprisingly been found that the intimate contact between the fire protection barrier and the substrate provided by the adhesive allows the intumescent to hold strongly to the substrate surface after expansion begins, even beyond temperatures at which the adhesive has failed. There is therefore no particular need for an adhesive that is resistant to the high temperatures encountered when structural steel fails, and an example of a suitable adhesive is an acrylic pressure sensitive adhesive. This is in contrast with wraps and other similar materials, which do not exhibit intimate contact with the substrate and can come loose once expansion of the intumescent coating begins, compromising fire protection.

The foregoing invention provides many useful advantages. A more aesthetically pleasing coating is provided than for other intumescent fire protection barriers. A uniform thickness can be applied and multiple layers can be installed one after the other, without waiting for the previous layer to cure. This dramatically decreases installation time. The invention does not require specially trained personnel for installation and safety issues are lessened as compared with solvent-based intumescent coatings. Humidity has a negligible effect as compared with sprayed on coatings. There is much less mess created during installation than for sprayed on coatings. Intimate contact between the fire protection barrier and the surface of the substrate being protected reduces the likelihood of premature detachment during a fire, which can be a problem with wraps or batts. The invention is particularly well suited to application around corners and on rounded surfaces.

BRIEF DESCRIPTION OF THE DRAWINGS

Having summarized the invention, preferred embodiments thereof will now be described with reference to the accompanying drawings, in which.

DETAILED DESCRIPTION

Figure 1A:
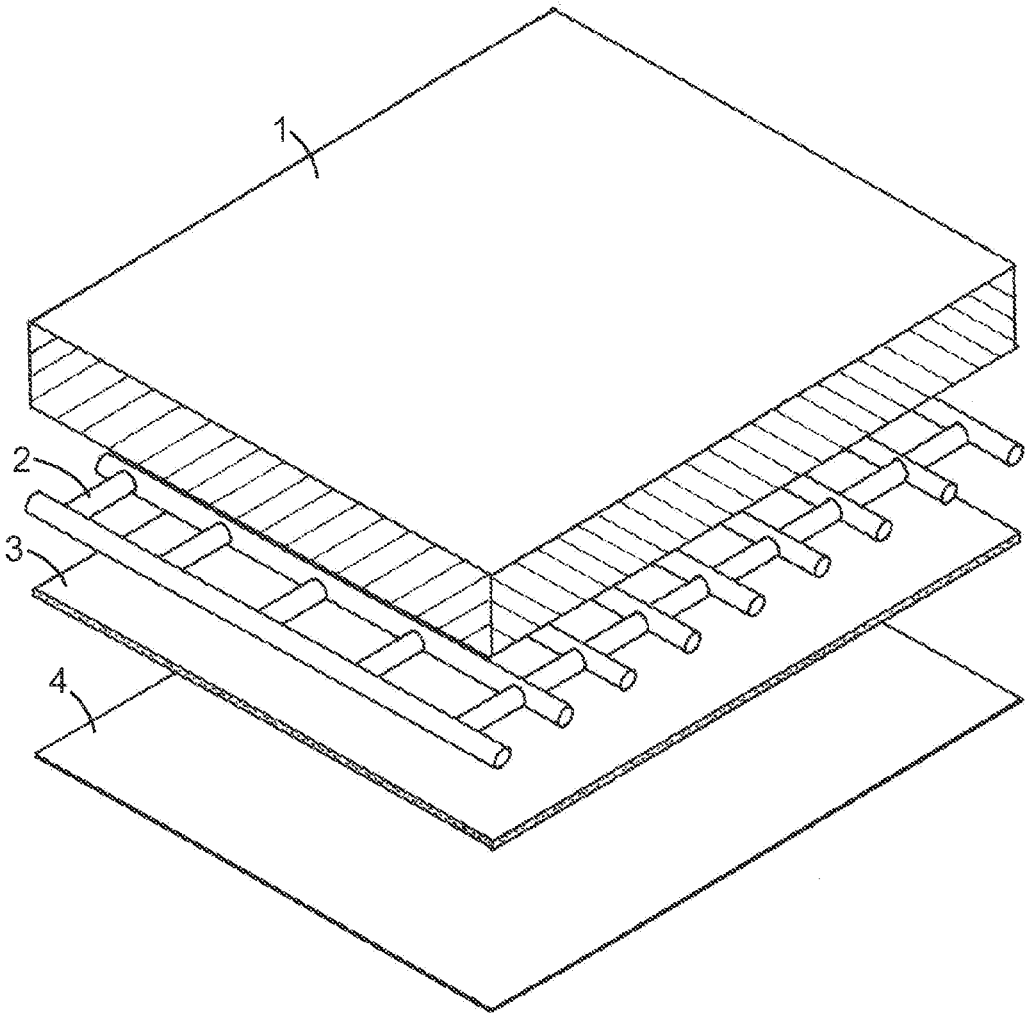
FIG. 1*a* is an exploded view of a fire-protection barrier according to the present invention having a woven fibrous reinforcing matrix.
Figure 1B:
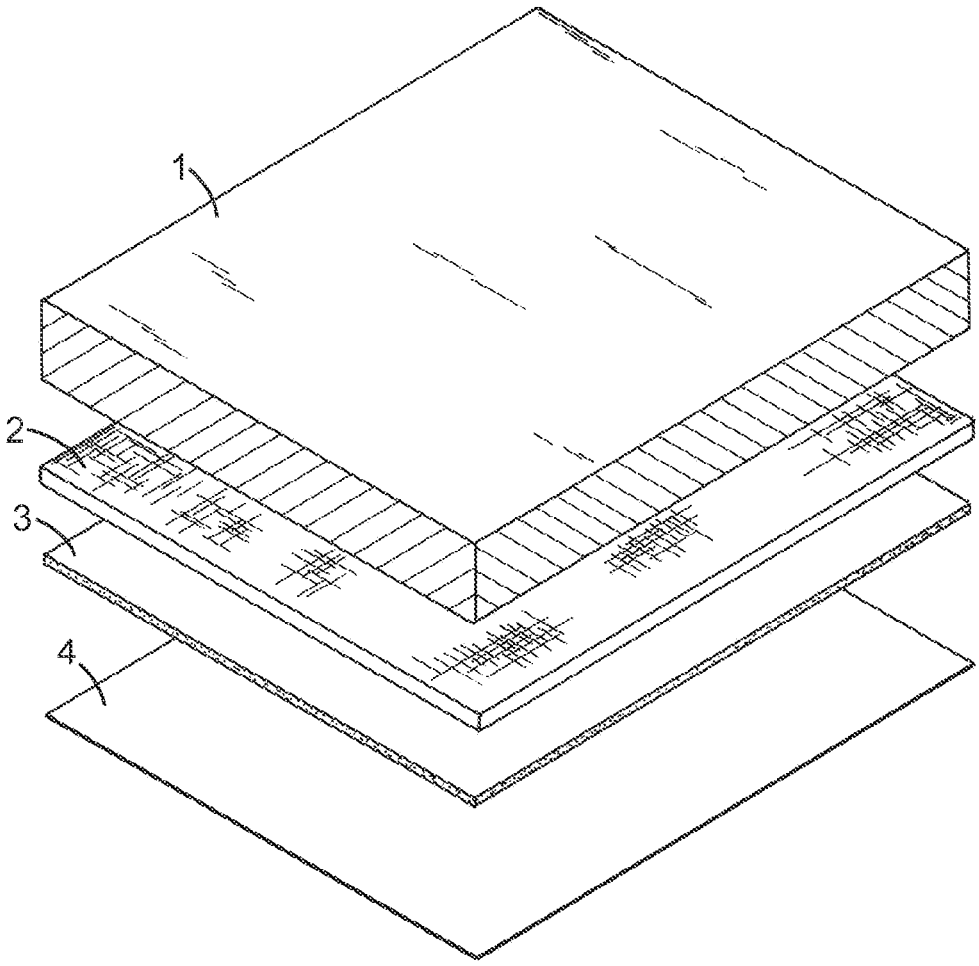
FIG. 1*b* is an exploded view of a fire-protection barrier according to the present invention having a non-woven fibrous reinforcing matrix.

Referring to FIGS. 1*a* and 1*b*, a fire protection barrier according to the present invention comprises a first layer 1 comprising a first intumescent material, a second layer 2 comprising a continuous porous reinforcing matrix, a third layer 3 comprising a pressure sensitive adhesive and a fourth layer 4 comprising a release liner removably adhered to the pressure sensitive adhesive. The fire protection barrier of FIG. 1*a* comprises a woven fibrous reinforcing matrix, whereas the fire protection barrier of FIG. 1*b* comprises a non-woven fibrous reinforcing matrix. The non-woven matrix of FIG. 1*b* may be comprised of randomly oriented fibers. This can be advantageous for manufacturing purposes and in preventing fissure propagation.

The intumescent material in the first layer 1 comprises at least four components: a mineral acid catalyst; a source of carbon; a blowing agent; and, a binder. Preferred examples of the foregoing include ammonium polyphosphate as the catalyst, pentaerythritol or dipentaerythritol as the carbon source, melamine as the blowing agent, and a thermoplastic or latex resin as the binder. The intumescent material begins expanding at a temperature of about 200° C. and expands by at least 10 times its original thickness, preferably at least 15 times, more preferably at least 20 times its original thickness. The original thickness of the intumescent material is from 0.25 to 3 mm, preferably from 0.5 to 1 mm. The exterior surface of the barrier has an aesthetically pleasing finish amenable to a variety of decorating finishes and may be painted in certain embodiments if so desired.

The reinforcing matrix is preferably porous so that, when assembled, the intumescent material of the first layer 1 is allowed to permeate and co-mingle with the second layer 2. The reinforcing matrix may be woven or non-woven and is preferably a fibrous thermoplastic web, screen, scrim or veil having a thickness of from 25 to 250 μm. The reinforcing matrix is preferably made from a polyester, polyamide, polyimide, polyurethane, polyvinylchloride or polyaramid material.

Although the reinforcing matrix may have a failure temperature higher than the intumescence temperature of the intumescent material, in a preferred embodiment the reinforcing matrix is designed to fail at a temperature less than the ultimate fire protection rating of the barrier (generally about 500-550° C. for steel). For the purposes of this description, failure is defined as a loss in structural integrity sufficient to allow physical separation to occur within the reinforcing matrix. For example, the reinforcing matrix may fail at a temperature between 200° C. and 500° C., preferably between 250° C. and 400° C. This advantageously provides structural support for the barrier during the initial stages of a fire, while permitting the reinforcing matrix to fail at a later point during the fire to thereby permit further expansion of the intumescent material, thereby conferring enhanced fire protection, particularly in multi-layer applications. It should be noted that, since the reinforcing matrix is located within the interior of the fire protection barrier, expansion of the intumescent material typically shields it from the head of the fire for a period of time so that, even if the failure temperature of the reinforcing matrix is similar to that of the intumescent material, failure will still occur after intumescence.

The preferred adhesive has a failure temperature higher than the intumescence temperature of the intumescent material, but a failure temperature less than the ultimate fire protection rating of the barrier. The adhesive may have a failure temperature less than about 400° C. For the purposes of this description, failure temperature is equivalent to the onset temperature of the adhesive, as determined from a thermal gravimetric analysis (TGA) curve. The term "onset temperature" is known and understood to persons skilled in the art.

Figure 6:
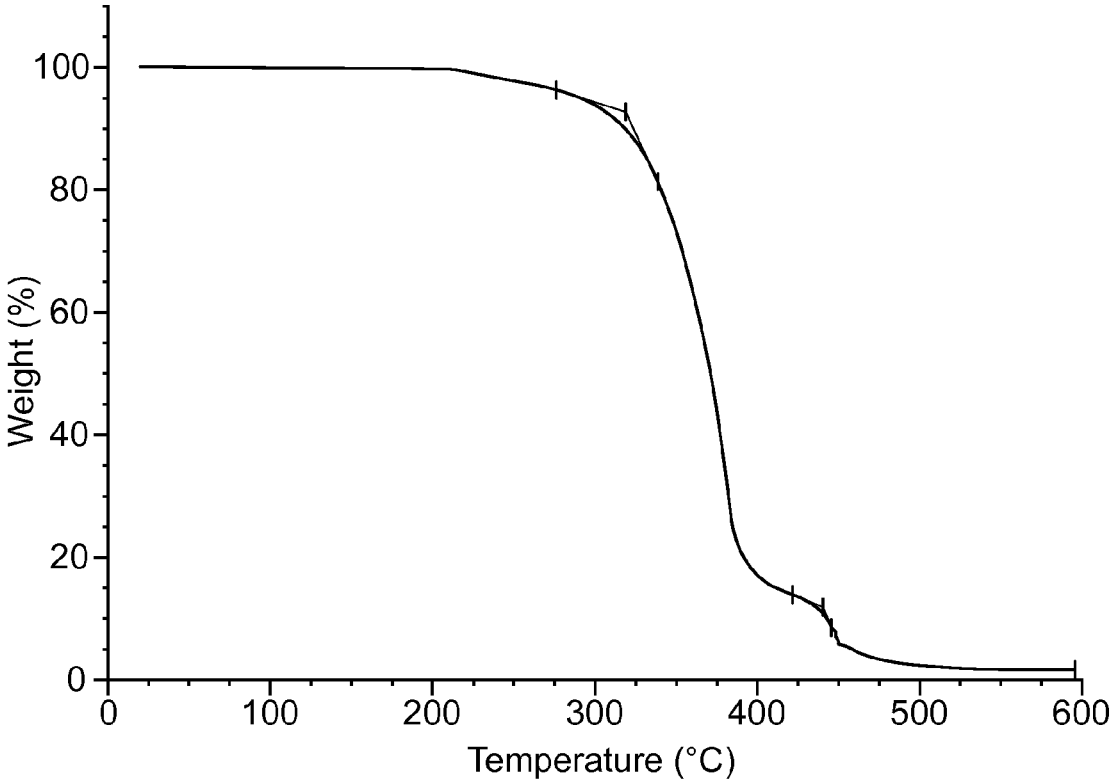

Preferred adhesives have a failure temperature of from 200 to 380° C., from 205 to 350° C., or from 210 to 330° C. A thermal gravimetric analysis for a suitable adhesive, conducted at a heating rate of 10° C./min, is provided in FIG. 6. The onset temperature is shown as about 320° C., where about 90% of the original weight of the adhesive remains. It will be noted that adhesives according to the invention are not required to retain their adhesive strength up to the failure temperature of steel (about 500° C.); this allows for the selection of less expensive and more commonly available adhesives, without comprising intimate contact between the fire protection barrier and the substrate surface.

The adhesive may be a pressure sensitive adhesive, for example a UV curable acrylic adhesive. One example of a particularly suitable pressure sensitive adhesive is 3M 200 MP™. The thickness of the adhesive layer 3 may be from 25 to 75 μm. The second and third layers 2, 3 have substantially the same length and width so that the adhesive is available for attaching the barrier to a substrate over the entirety of its surface. This provides good attachment between the barrier and the substrate and reduces the likelihood of premature detachment.

The release layer 4 comprises a suitable material known to persons skilled in the art to be compatible with the selected adhesive. The release layer 4 normally comprises a coated paper material of suitable thickness to provide protection for the adhesive layer 3, while still being easily peeled for installation of the fire protection barrier.

Fire protection barriers according to the present invention may be manufactured using techniques suitable for the manufacture of tape. These techniques may start by providing a continuous strip of the reinforcing matrix while spray coating the intumescent material on one side and the adhesive on the opposite side. Another approach is to provide the release liner with the adhesive applied thereto and blow random fibers on to the adhesive in order to form the reinforcing matrix. The intumescent material can then be coated on to the reinforcing matrix. The adhesive and/or intumescent may optionally be cured, for example using heat or ultraviolet light. The release layer can be provided with the adhesive layer, or provided after the adhesive and reinforcing matrix are attached to one another. The finished tape is wound into rolls. These techniques and machines capable of manufacturing tape in continuous rolls are known to persons skilled in the art and are described in, for example the *Handbook of Pressure Sensitive Adhesive Technology* 3$^{rd}$ edition, 1999, edited by Donatas Satas, which is incorporated herein by reference.

Figure 2A:
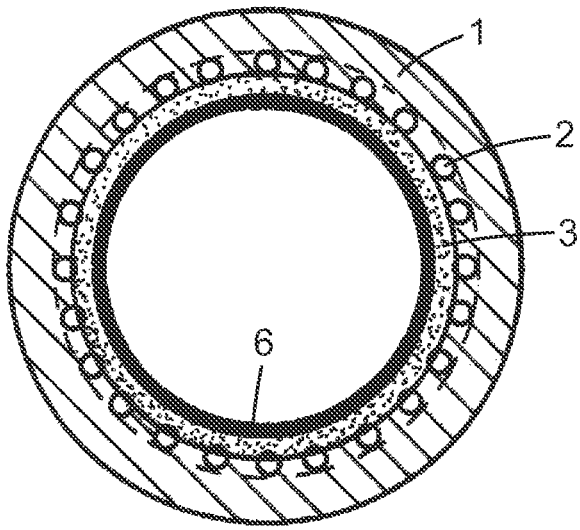
FIG. 2*a* is a top cross-sectional view of the barrier applied to a tube having a circular cross-section.
Figure 2B:
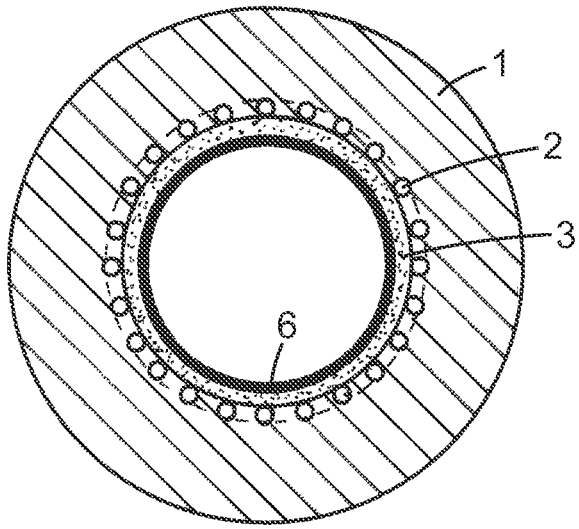
FIG. 2*b* shows the barrier of FIG. 2*a* with expansion of intumescent material during a fire.

Referring to FIG. 2*a*, the fire protection barrier of the present invention is particularly well suited to application on rounded surfaces such as hollow structural section (HSS) tubing having a circular cross section, as shown, on tubing having a square or rectangular cross section, on angle iron or on I-beams. The barrier is applied by peeling the release layer 4 to expose the adhesive layer 3 and pressing it uniformly against the pipe 6. The adhesive layer 3 thereby places the barrier in intimate contact with the pipe 6 over substantially the entire surface of the barrier. The ends of the barrier are either abutted or slightly overlapped and the barrier is readily cut to any desired length to facilitate application. Referring to FIG. 2*b*, upon heating the intumescent layer 1 expands by at least 10 times its original thickness to insulate the pipe 6 from the effects of the fire for a limited period of time. A self-supporting char is created that surprisingly requires little or no adhesive attachment to the substrate in order to remain in intimate contact therewith during the later stages of the fire. Intimate contact results in a char that is less likely to prematurely separate from the substrate during a fire, which can comprise the fire protection provided by the barrier.

Figure 3A:
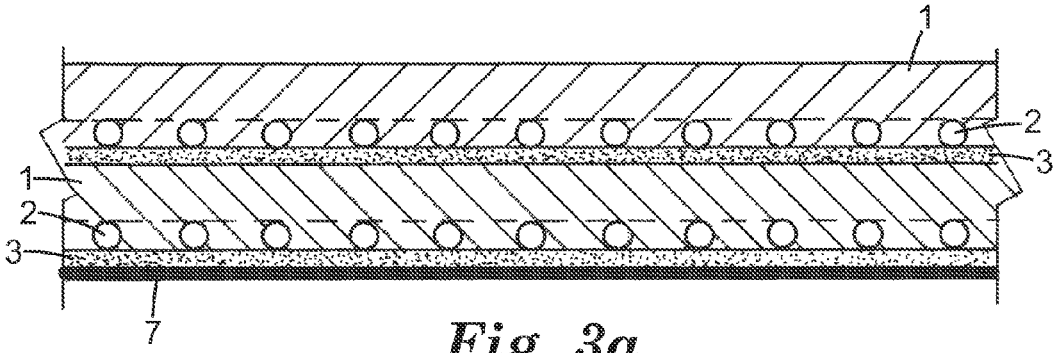
FIG. 3*a* is a side cross-sectional view showing multiple fire protection barriers of the present invention sequentially applied to a planar surface of a tube having a rectangular cross-section.
Figure 3B:
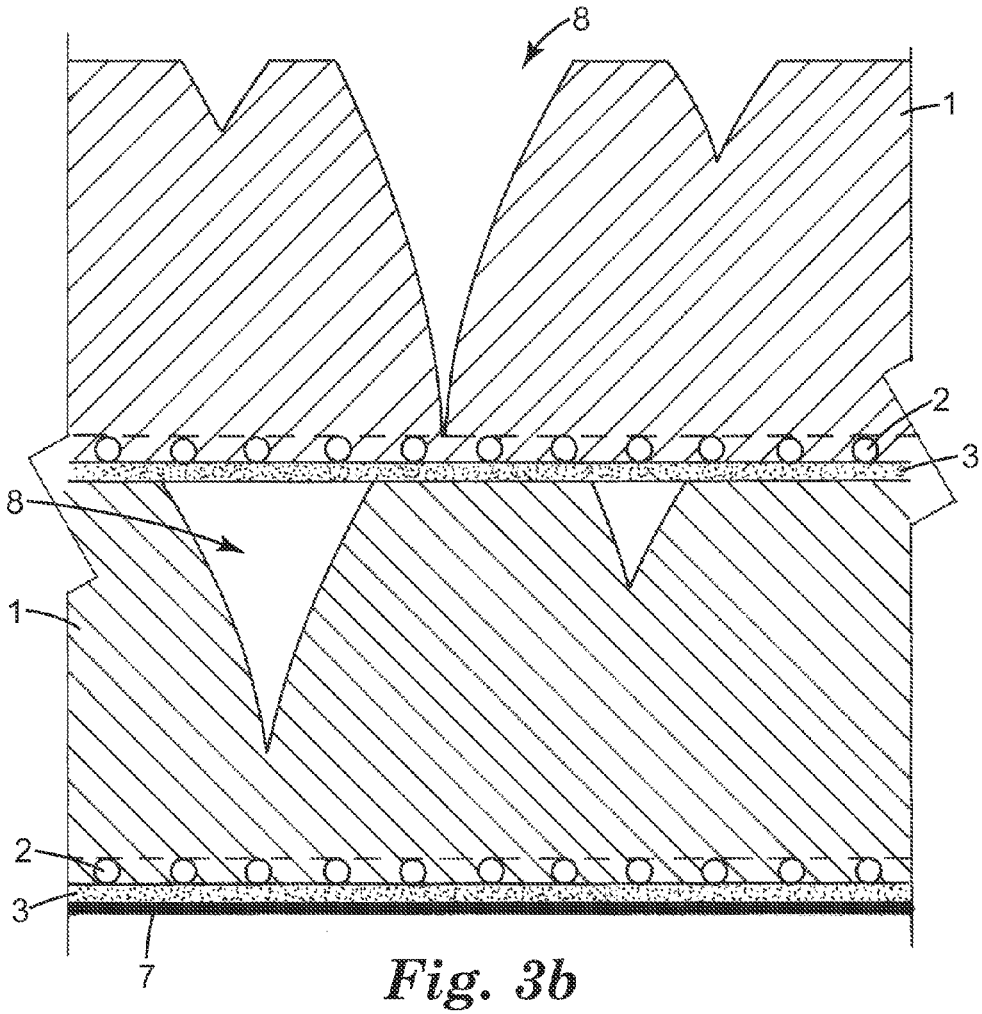
FIG. 3*b* shows the barriers of FIG. 3*a* with fissure formation during expansion of the intumescent material, the fissures located at different locations on different barriers.

Referring to FIG. 3*a*, the method described above with reference to FIGS. 2*a* and 2*b* can be repeated to sequentially apply a plurality of the fire protection barrier to a steel substrate 7. This allows a greater quantity of intumescent to be applied when the thickness of intumescent material required to achieve a desired fire protection rating exceeds the thickness of a single application of the fire protection barrier. The intumescent materials used in successive fire protection barriers applied in this manner may be identical or different to provide different intumescence temperatures for the different layers. Referring to FIG. 3*b*, since a plurality of the fire protection barrier of the present invention may be sequentially applied, even if a fissure 8 forms in one barrier, it is unlikely to form in the same place in an adjoining barrier. This means that the substrate 7 rarely becomes exposed due to a fissure 8 propagating from the exterior all the way through the plurality of fire protection barriers. In addition, propagation of a fissure 8 tends to be arrested by the reinforcing matrix 2 and the depth of penetration of a particular fissure is therefore limited to the thickness of an individual intumescent layer 1.

The substrate 7 shown is a planar surface of an HSS tube having a square or rectangular cross section. Although fissures normally form upon expansion of the barrier on rounded surfaces or corners, in-homogeneous heating of an HSS tube having a square cross-section causes the portion of the fire protection barrier closest to the heat source to expand first, thereby pulling upon the remainder of the barrier opposite the heat source. This in turn can lead to fissure formation on planar surfaces away from the heat source, such as shown in FIG. 3*b*. The barrier of the present invention is effective at preventing fissure propagation on planar surfaces, on rounded surfaces or on corners.

Figure 4A:
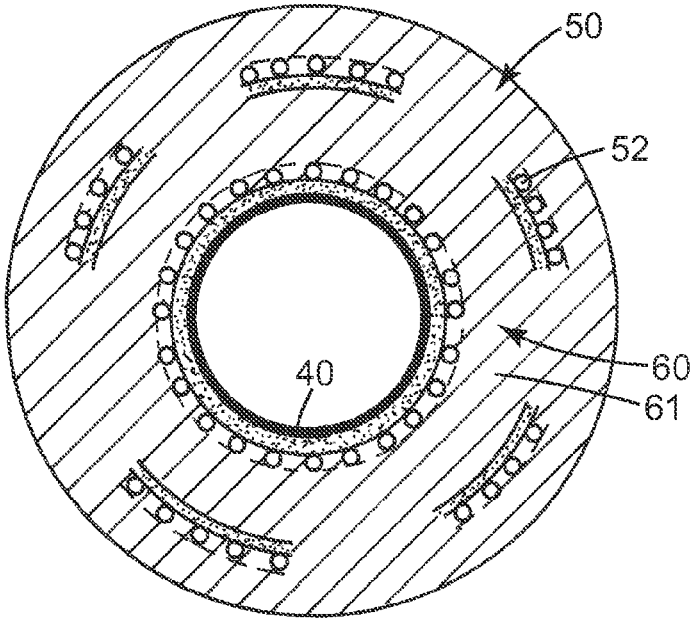
FIG. 4*a* shows the barrier of FIG. 2*b* with failure of the reinforcing matrix during a fire permitting expansion of the intumescent material in multiple directions.
Figure 4B:
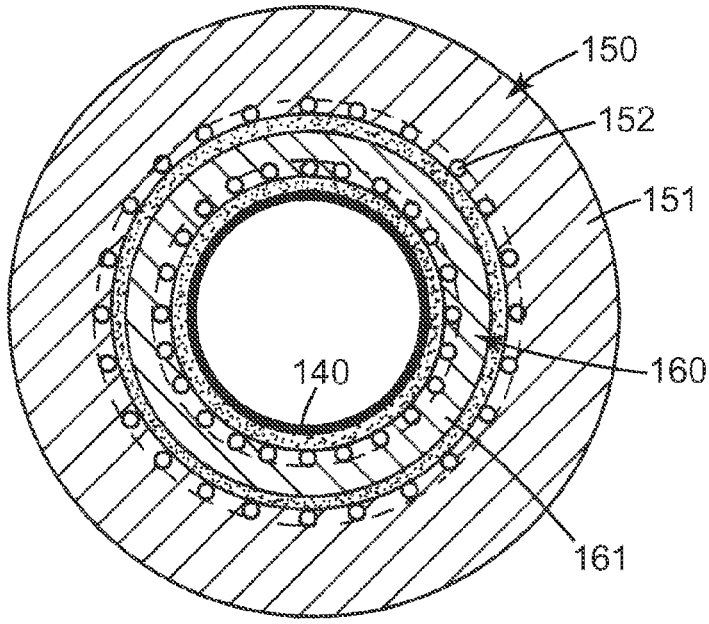
FIG. 4*b* shows the barrier of FIG. 2*b* without failure of the reinforcing matrix during a fire, thereby constraining expansion of the intumescent material through the reinforcing matrix of each successive fire protection barrier.

Referring to FIGS. 4*a* and 4*b*, there are at least two potential ways in which multiple sequentially applied fire protection barriers can accommodate expansion, particularly on a non-planar surface. Referring to FIG. 4*a*, in one embodiment, a substrate 40 having a circular cross-section is protected by a first outer barrier 50 and a second inner barrier 60. The reinforcing matrix 52 of the first barrier 50 is designed to fail upon intumescence of the intumescent layer 61 of the second inner barrier 60. This permits the intumescent layer 61 to expand fully without being constrained in its expansion by the reinforcing matrix 52. The reinforcing matrix 52 may fail, for example, by melting, burning or separating. Fragments of the reinforcing matrix 52 are then present within the intumescent material after expansion. These fragments can provide some reinforcement to the intumescent material and limit fissure propagation through the material to expose the bare metal. The reinforcing matrix 52 is typically designed to fail at a temperature greater than the intumescence temperature of the barrier, but less than the ultimate fire rating of the substrate 40. In this embodiment, the reinforcing matrix 52 fails at a temperature from 250 to 400° C. Referring to FIG. 4*b*, in another embodiment, a substrate 140 having a circular cross-section is protected by a first outer barrier 150 and a second inner barrier 160. The reinforcing matrix 152 of the first outer barrier 150 is not designed to fail upon intumescence of the intumescent layer 161 of the second inner barrier 160. In this embodiment, the reinforcing matrix 152 is a temperature resistant material, for example a steel mesh or ceramic fiber material. The intumescent layer 161 is forced to expand through the porous reinforcing matrix 152 and join with the intumescent layer 151 of the first outer barrier 150. Either approach can be used to good effect in certain applications.

Figure 5:
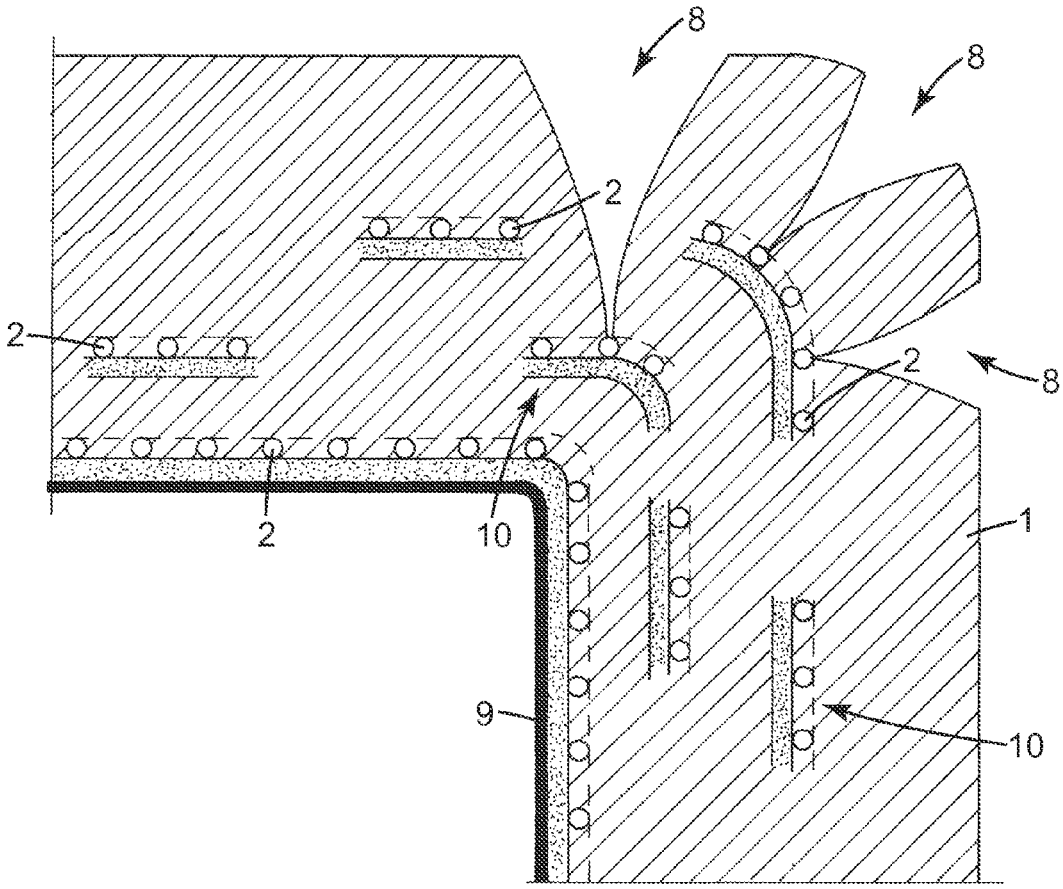
FIG. 5 shows a corner of a section of hollow tubing having a rectangular cross section with multiple fire protection barriers applied thereto and fissure propagation limited by fragments of a failed reinforcing web; and, FIG. 6 shows a thermal gravimetric analysis of a suitable adhesive for use in fire protection barriers according to the invention, conducted at a heating rate of 10° C./min.

Referring to FIG. 5, a corner of a section of hollow tubing having a rectangular cross section forms a substrate 9 with multiple fire protection barriers applied thereto. Each fire protection barrier includes a reinforcing matrix 2. Upon expansion due to fire, the intumescent material 1 of each barrier intermingles with the intumescent material of adjacent barriers and the reinforcing matrix of at least the exterior barriers fails in a random fashion to form fragments 10. Fissures 8 formed at the corners due to expansion of the intumescent material are arrested in their propagation through the intumescent material 1 by the presence of fragments 10. Since the fissures 8 cannot propagate all the way through the intumescent material 1, bare metal is not exposed during the fire, which leads to increased overall fire protection time.

The use of both an intumescent coating and a reinforcing matrix in the same fire protection barrier provides surprising synergistic effects relating to decreased fissure propagation. Fire protection ratings equivalent to or better than sprayed on coatings with the same intumescent dry film thickness can be obtained using the fire protection barrier of the present invention, particularly when applied on rounded or cornered surfaces. The use of an adhesive is significant in that it reduces overall application time and surface preparation time, while also reducing dependency on environmental conditions and applicator skill level. These surprising advantages are conferred by the multi-layer structure of the present invention.

Example 1

An intumescent material was prepared using commercially available components. The intumescent material included the components listed in Table 1.

TABLE 1

Composition of intumescent material

| Material | Supplier | wt % |
|---|---|---|
| Water | | 15-25 |
| Ammonium polyphosphate | Clariant (Frankfurt, Germany) | 15-30 |
| Melamine | DSM (Sittard, The Netherlands) | 5-15 |
| Pentaerythritol | Perstorp (Toledo, USA) | 5-15 |
| Latex binder | Air Products (Utrecht, The Netherlands) | 15-25 |
| Other additives | | 10-20 |

A layer of a non-woven polyester veil (Optimat™, Technical Fibre Products, Newburg, N.Y.) having a weight of 7 g/m$^2$ and a thickness of 0.06 mm was provided and the intumescent material was applied uniformly thereto. The intumescent material was then dried at a temperature of 20° C. for 24 hours, followed by drying at 70° C. for another 8 hours. The dried composite was then laminated with a 3M 200 MP™ adhesive film (3M, St. Paul, Minn.) having a thickness of 0.05 mm. A release liner was included with the adhesive layer as obtained from the supplier and was included in the finished product. The final thickness of the fire protection barrier ranged from 0.5 to 1 mm, with a width of 30 cm (12").

A steel plate having dimensions 12"×12"×¼" (30×30×0.625 cm) was sand blasted and primed. Three successive layers of the fire protection barrier were applied, with a certain degree of overlap between successive layers. The total average thickness of the fire protection barrier was 2.75 mm. However, since the barrier included both a reinforcing web and an adhesive layer, it was calculated that the equivalent dry film thickness (DFT) of the intumescent material in the barrier was 2.42 mm. Application time was several minutes.

A control plate having the same dimensions was prepared using standard techniques. The plate was sand blasted and primed, then allowed to dry. Three coats of the intumescent material described with reference to Table 1 were applied to the plate. Each coat was allowed to dry for one day before the next coat was applied. The total application time was three days. The total dry film thickness (DFT) was 2.92 mm.

The plates were each exposed to a standard ASTM E119 simulated fire. The fire is simulated in a programmable furnace that drives the temperature to 843° C. after 30 minutes, 927° C. after 1 hour and 1010° C. after 2 hours. The test ends when the average temperature of the steel reaches 538° C., which is considered to be the failing temperature of structural steel. The results of the test are provided in Table 2.

TABLE 2

ASTM E119 Fire Protection Test Results for Steel Plate

| | Total thickness (mm) | DFT intumescent (mm) | Expansion Ratio | Fire resistance time (min) |
|---|---|---|---|---|
| Invention | 2.75 | 2.42 | 19 | 125 |
| Control | 2.92 | 2.92 | 21 | 129 |

As can be seen from Table 2, the plate protected by the fire protection barrier of the present invention reached a temperature of 538° C. after 125 minutes, which is comparable to the time taken by the control plate (129 minutes) to reach the same temperature. The comparability of these results is particularly surprising considering that the DFT of the invention was 0.5 mm less than the DFT of the control (about 17% less). The expansion ratio of the intumescent materials, calculated on the basis of DFT before and after the test, was comparable for the two materials. Visual observation indicated little or no fissure formation or delamination on the flat plate, so the test results were not negatively influenced by exposure of bare steel for the intumescent coating.

The test was repeated with the plate suspended in the inverted position and it was observed that the invention exhibited good adhesion following the test. This is also surprising in that there would be little or no attachment provided by the adhesive layer following exposure to the high temperature (538° C.) test conditions. The char formed by the barrier of the present invention is therefore both self supporting and self adhering to the substrate following expansion of the intumescent material.

Example 2

A fire protection barrier according to the present invention was prepared in accordance with Example 1. A length of hollow section steel (HSS) column having a rectangular cross section with nominal dimensions 3"×5"×⅜" (7.6×12.7×0.95 cm) and length 4 ft (120 cm) was cleaned, but not sand blasted or primed; the omission of these surface preparation steps dramatically reduces overall application time. Between 3 and 4 layers of the barrier were wrapped around the column from a continuous tape roll. The thickness was measured in several locations and the average was calculated to be 2.54 mm. The DFT of intumescent material in the barrier was calculated to be 2.21 mm. The process took on the order of an hour.

A control HSS column of equivalent dimensions was prepared by sand blasting and priming. After the primer was allowed to dry, an intumescent coating having a composition as previously described with reference to Example 1 was applied using the conventional spray coating technique. Three successive coats were applied to an average thickness of 2.6 mm. Each coat was allowed to dry before the next coat was applied. The entire process took about 3 days to complete.

The columns were exposed to an ASTM E119 simulated fire as described in Example 1. The results of the test are provided in Table 3.

TABLE 3

ASTM E119 Fire Protection Test Results for HSS Column, small DFT

| | Total thickness (mm) | DFT intumescent (mm) | Fire resistance time (min) |
|---|---|---|---|
| Invention | 2.54 | 2.21 | 58 |
| Control | 2.61 | 2.61 | 62 |

As can be seen from Table 3, the HSS column with the fire protection barrier according to the present invention reached a temperature of 538° C. after 58 minutes, which is comparable to the time taken by the control plate (62 minutes) to reach the same temperature. The comparability of these results is particularly surprising considering that the DFT of the invention was 0.4 mm less than the DFT of the control (about 20% less). The expansion ratio of the two was comparable. Visual observation of the two after the test showed significant fissure formation, particularly at the corners of the HSS tubing. Although in the control the fissures propagated all the way through the sprayed on coating to expose the bare steel, the fissures obtained with the invention did not propagate all the way through the barrier. Due to the thin DFT and relatively short duration of the test, exposure of the bare steel did not seem to have a significant negative effect on the fire protection rating of the control.

It is surmised that the relatively superficial fissures obtained with the invention are a result of the use of successive layers of a reinforcing web that fails randomly during the fire in order to create a self-reinforcing structure that limits continuous fissure formation. This results in a greater fire protection rating for an equivalent (or slightly reduced) DFT as compared with a sprayed on coating. Since structural applications generally require thicker DFT in order to attain a two hour fire protection rating, the observed mitigation of fissure formation and resulting performance improvement provides an unexpected and surprising performance advantage for the present invention. When considered along with the dramatic reduction in application time, this superior performance is even more unexpected and provides significant commercial advantages.

The foregoing embodiments are illustrative of the invention and are meant to be construed in a non-limiting sense. Those skilled in the art will recognize that further features, variation and sub-combinations of the present invention may be provided without departing from the spirit of the invention as described herein, and are intended by the inventor to be encompassed by the following claims.

What is claimed is:

1. A method of protecting a hollow structural tubing building component from fire damage comprising:

providing a multi-layer fire protection barrier comprising a first layer comprising an intumescent material and comprising first and second oppositely-facing major surfaces, a second layer comprising a continuous reinforcing matrix, a third layer comprising a pressure sensitive adhesive and a fourth layer comprising a release liner removably adhered to the third layer;

removing the fourth layer from the fire protection barrier to expose the third layer;

and, wrapping the multi-layer fire protection barrier around an outer surface of the hollow structural tubing building component and applying the pressure sensitive adhesive of the third layer to the surface of the hollow structural tubing building component to adhesively attach the fire protection barrier to the hollow structural tubing building component so that the first major surface of the first layer is an exposed outer surface of the multi-layer fire protection barrier, wherein the continuous reinforcing matrix fails during a fire so as to form fragments within the intumescent material that limit fissure propagation through the intumescent material.

2. The method of claim 1, wherein the adhesive places the barrier in intimate contact with the surface of the hollow structural tubing building component.

3. The method of claim 1, wherein the method is repeated to sequentially apply a plurality of the fire protection barriers to the hollow structural tubing building component.

4. The method of claim 1, wherein the time required to apply a given dry film thickness (DFT) of the intumescent material is reduced as compared with the time required to apply the same DFT of the intumescent material using a spray coating technique.

5. The method of claim 1, wherein the reinforcing matrix is porous and wherein the second layer is co-mingled with the first layer.

6. The method of claim 5, wherein the second layer is entirely within the first layer.

7. The method of claim 1, wherein the intumescent material comprises a catalyst, a carbon source, a blowing agent and a thermoplastic binder.

8. The method of claim 7, wherein the catalyst comprises ammonium polyphosphate, the carbon source comprises pentaerythritol or dipentaerythritol, the blowing agent comprises melamine and the binder comprises a thermoplastic or latex resin.

9. The method of claim 1, wherein the reinforcing matrix comprises a fibrous screen, web, scrim or veil made from a polyester, polyamide, polyimide, polyurethane, polyvinylchloride or polyaramid material.

10. The method of claim 1, wherein the intumescent material has an intumescence temperature and wherein the reinforcing matrix has a failure temperature higher than the intumescence temperature.

11. The method of claim 10 wherein the intumescence temperature is at least 200° C.

12. The method of claim 11, wherein the reinforcing matrix has a failure temperature less than 400° C.

13. The method of claim 1, wherein the intumescent material has an intumescence temperature and wherein the adhesive has a failure temperature higher than the intumescence temperature.

14. The method of claim 13, wherein the adhesive has a failure temperature less than 400° C.

15. The method of claim 1, wherein the pressure sensitive adhesive comprises an acrylic adhesive compound.

16. The method of claim 1, wherein the intumescent material expands during a fire by at least 10 times its original thickness.

17. The method of claim 1, wherein the intumescent material forms a self-supporting char following expansion.

18. The method of claim 1, wherein the method comprises applying the fire protection barrier to an outside surface of a hollow structural tubing building component that has a circular, square or rectangular cross section.

19. The method of claim 18, wherein the hollow structural tubing building component is made of steel.

20. A method of protecting a hollow structural tubing building component from fire damage comprising:

providing a multi-layer fire protection barrier comprising a first layer comprising an intumescent material and comprising first and second oppositely-facing major surfaces, a second layer comprising a continuous reinforcing matrix, a third layer comprising a pressure sensitive adhesive and a fourth layer comprising a release liner removably adhered to the third layer;

removing the fourth layer from the fire protection barrier to expose the third layer;

and, wrapping the multi-layer fire protection barrier around an outer surface of the hollow structural tubing building component and applying the pressure sensitive adhesive of the third layer to the surface of the hollow structural tubing building component to adhesively attach the fire protection barrier to the hollow structural tubing building component so that the first major surface of the first layer is an exposed major surface.

* * * * *